US010183830B2

(12) United States Patent
Hsu

(10) Patent No.: US 10,183,830 B2
(45) Date of Patent: Jan. 22, 2019

(54) FIBER PRODUCT FOLDING APPARATUS

(71) Applicant: CHAN LI MACHINERY CO., LTD., Taoyuan (TW)

(72) Inventor: Chi-Pin Hsu, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 451 days.

(21) Appl. No.: 14/979,861

(22) Filed: Dec. 28, 2015

(65) Prior Publication Data

US 2016/0362272 A1 Dec. 15, 2016

(30) Foreign Application Priority Data

Jun. 11, 2015 (TW) ..... 104118933 A

(51) Int. Cl.

| | |
|---|---|
| ***B65H 29/66*** | (2006.01) |
| ***B65H 45/18*** | (2006.01) |
| ***B65H 45/24*** | (2006.01) |
| *D06F 89/00* | (2006.01) |

(52) U.S. Cl.

CPC ..... *B65H 29/6609* (2013.01); *B65H 45/18* (2013.01); *B65H 45/24* (2013.01); *B65H 2406/341* (2013.01); *B65H 2406/351* (2013.01); *B65H 2701/18271* (2013.01); *B65H 2701/1924* (2013.01); *D06F 89/00* (2013.01)

(58) Field of Classification Search

CPC ..... B65H 2406/351; B65H 2701/1924; B65H 45/02; B65H 45/04; B65H 45/18; B65H 45/24; D06F 89/00–89/026

USPC ..... 493/413, 442, 444, 450; 270/39.01, 270/39.05, 39.06, 39.07, 46, 51; 223/37, 223/38

See application file for complete search history.

(56) References Cited

U.S. PATENT DOCUMENTS

| | | | | |
|---|---|---|---|---|
| 6,182,418 | B1 * | 2/2001 | McFarland | B65D 83/0894 493/411 |
| 6,228,014 | B1 * | 5/2001 | De Matteis | B65H 45/24 493/424 |
| 6,321,512 | B1 * | 11/2001 | O'Connor | B65B 5/04 53/429 |
| 6,685,050 | B2 * | 2/2004 | Schmidt | A47K 10/421 206/494 |

(Continued)

FOREIGN PATENT DOCUMENTS

| | | | | |
|---|---|---|---|---|
| BR | 102016006340 | A2 * | 12/2016 | B65H 45/18 |
| EP | 3103747 | A1 * | 12/2016 | B65H 45/18 |

(Continued)

*Primary Examiner* — Hemant M Desai
*Assistant Examiner* — Valentin Neacsu
(74) *Attorney, Agent, or Firm* — Rosenberg, Klein & Lee

(57) ABSTRACT

The present invention relates to a fiber product folding apparatus, mainly including a hoisting seat, a baffle, a pressing plate, and a folding portion, where the baffle is connected to at least one swing arm and can actuate the baffle to swing through the swing arm, so as to block stacked fiber products. The pressing plate is connected to the hoisting seat though a connecting rod, where the connecting rod can actuate the pressing plate to swing relative to the hoisting seat and pressurize to the stacked fiber products. A folding portion is arranged on the pressing plate and can move along the pressing plate, so as to fold a first fiber product of the stacked fiber products.

8 Claims, 10 Drawing Sheets

(56) References Cited

U.S. PATENT DOCUMENTS

| | | | | |
|---|---|---|---|---|
| 8,128,079 | B2 * | 3/2012 | Hsu | B65H 31/32<br>270/39.01 |
| 9,004,480 | B2 * | 4/2015 | Hsu | B65H 45/24<br>270/39.01 |
| 2001/0014643 | A1 * | 8/2001 | Sander | B65H 31/12<br>493/433 |
| 2003/0078148 | A1 * | 4/2003 | Hailey | B65H 18/00<br>493/413 |
| 2009/0120972 | A1 * | 5/2009 | Saji | D06F 89/02<br>223/37 |
| 2011/0131844 | A1 * | 6/2011 | Kusunoki | D06F 67/04<br>38/2 |
| 2012/0165174 | A1 * | 6/2012 | Butterworth | B31F 1/0003<br>493/451 |

FOREIGN PATENT DOCUMENTS

| | | | | | |
|---|---|---|---|---|---|
| JP | 10101264 | | | 4/1998 | |
| JP | 201163440 | A | | 3/2011 | |
| JP | 2017001882 | A | * | 1/2017 | B65H 45/18 |
| JP | 6228255 | B2 | * | 11/2017 | B65H 45/18 |
| WO | 9823519 | | | 6/1998 | |

* cited by examiner

FIBER PRODUCT FOLDING APPARATUS

REFERENCE TO RELATED APPLICATIONS

This application is based on Provisional application Ser. No. 104118933, filed Jun. 11, 2015, currently pending.

BACKGROUND

Technical Field

The present invention relates to a fiber product folding apparatus and can be used to fold a first fiber product among stacked fiber products.

Related Art

Reference may be made to FIG. 1, which is a construction schematic diagram of a common fiber product folding apparatus. As shown in the drawing, a common fiber product folding apparatus 10 mainly includes two folding wheels 11, two stacking units 13, a first carrying unit 15, a blocking unit 17, and a carrying seat 19. The two folding wheels 11 may rotate in opposite directions and form a folding line on a fiber product 12, and the stacking unit 13 is used to stack the fiber product 12 on the first carrying unit 15, so as to complete folding the fiber product 12.

The blocking unit 17 is mainly used to separate the stacked fiber products 12, for example, when the number of folded fiber products 12 reaches a certain quota, the blocking unit 17 would extend out. When the blocking unit 17 extends out and cooperates with the carrying seat 19 to convey the fiber products 12, an exposed fiber product 121 would be naturally generated outside the first carrying unit 15.

Generally speaking, after the fiber products 12 are stacked, the exposed fiber product 121 would become the first one of removable fiber products. In order to facilitate taking out a first fiber product by a user, the fiber product folding apparatus 10 usually needs to be provided with two folding units 14 additionally, where the two folding units 14 are arranged in parallel to each other, and a gap exists between the two. In addition, the two folding units 14 may approach or be distant from each other, and when the two approach each other, an overlapped area would be generated, and the exposed fiber product 121 located between the two folding units 14 is folded.

Although the first fiber product may be located at the central position of the stacked fiber products by means of the common fiber product folding apparatus 10, the fiber product 121 folded by the folding unit 14 would be located at the bottommost position of the stacked fiber products 12. Therefore, after the fiber products 12 are stacked, it is also necessary to turn the stacked fiber products 12 by 180 degrees additionally by means of a turnover apparatus.

SUMMARY

One purpose of the present invention is providing a fiber product folding apparatus, which is mainly used to fold a first fiber product among stacked fiber products, so as to enable a folded place of the first fiber product to be close to the central position of the fiber product and facilitate taking out the first fiber product by a user.

Another purpose of the present invention is providing a fiber product folding apparatus, which is mainly used to make a mechanism for folding a fiber product dependent from a mechanism for stacking fiber products, so as to enable the fiber product folding apparatus to fold the topmost fiber product of the stacked fiber products and omit a step of turning over the stacked fiber products in the prior art.

To achieve these and other objects of the present invention, the present invention provides a fiber product folding apparatus, comprising: a hoisting seat; a baffle, connected to at least one swing arm, wherein the swing arm actuates the baffle to swing, and the baffle is used to block one of stacked fiber products; a pressing plate, connected to the hoisting seat through at least one connecting rod and at least one connecting unit, wherein the connecting rod is used to actuate the pressing plate to swing with the connecting unit as a pivotal support, so that the pressing plate gets in contact with the topmost fiber product among the stacked fiber products; at least one absorbing unit, arranged on a surface of the pressing plate and is used to absorb the topmost fiber product among the stacked fiber products; and a folding portion, arranged on the pressing plate, wherein the folding portion moves along the pressing plate and is used to fold the topmost fiber product among the stacked fiber products.

In one embodiment of the fiber product folding apparatus, the connecting rod is connected to the hoisting seat through a driving unit, and the driving unit is used to drive the connecting rod to actuate the pressing plate to swing with the connecting unit as a pivotal support.

In one embodiment of the fiber product folding apparatus, the driving unit is a cylinder or a crankshaft.

In one embodiment of the fiber product folding apparatus, further comprises a fixed seat and a hoist driving unit, wherein the fixed seat is connected to the hoisting seat through the hoist driving unit, and the hoisting seat is driven by the hoist driving unit to move relative to the fixed seat.

In one embodiment of the fiber product folding apparatus, the baffle is connected to the fixed seat through the swing arm.

In one embodiment of the fiber product folding apparatus, the folding portion comprises a folding plate and a connecting seat, the folding plate is connected to the pressing plate through the connecting seat, and the connecting seat is used to actuate the folding plate to move along the pressing plate.

In one embodiment of the fiber product folding apparatus, the baffle is connected to the hoisting seat through the swing arm.

In one embodiment of the fiber product folding apparatus, the number of swing arms is two or more, and the swing arms are in parallel to each other and form a parallel linkage.

In one embodiment of the fiber product folding apparatus, the absorbing unit is arranged on a part of the surface of the pressing plate.

In one embodiment of the fiber product folding apparatus, the absorbing unit is arranged on the surface of the pressing plate that is closer to the connecting unit side.

Figure 1:
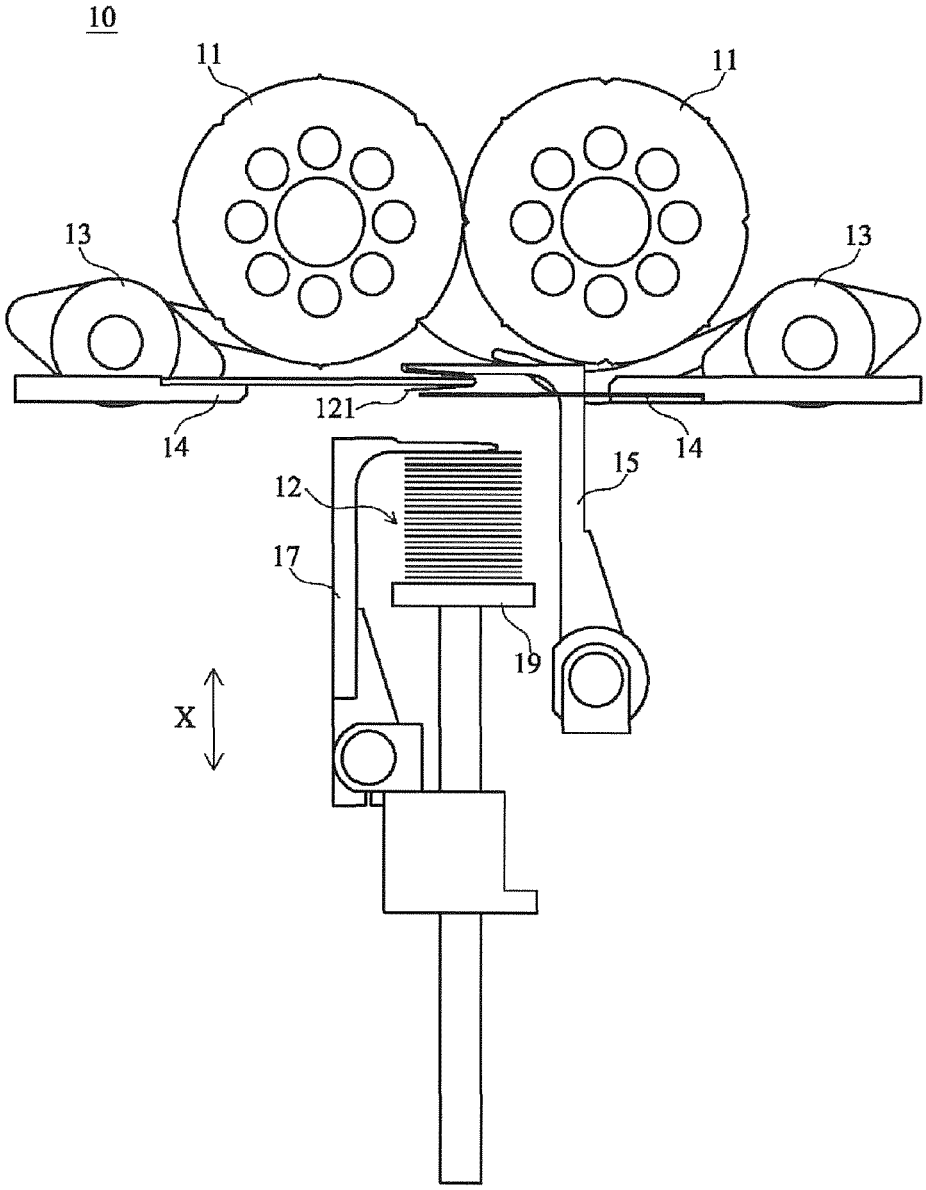
FIG. 1 (Prior art)
FIG. 1 is a construction schematic diagram of a common fiber product folding apparatus.

Although specific implementation manners of the present invention are described in the drawings by using examples, and detailed descriptions are made for them in this disclosure, the present invention also allows various modifications and replacement forms. The contents of the drawings of the present invention may be disproportional, the drawings and their detailed descriptions are merely disclosure in specific forms and are not limitations to the present invention, and on the contrary, modifications made according to the spirit and scope of the patent, as well as equivalent components and their replacement, all fall within the scope covered by the present invention.

DETAILED DESCRIPTION

Figure 2:
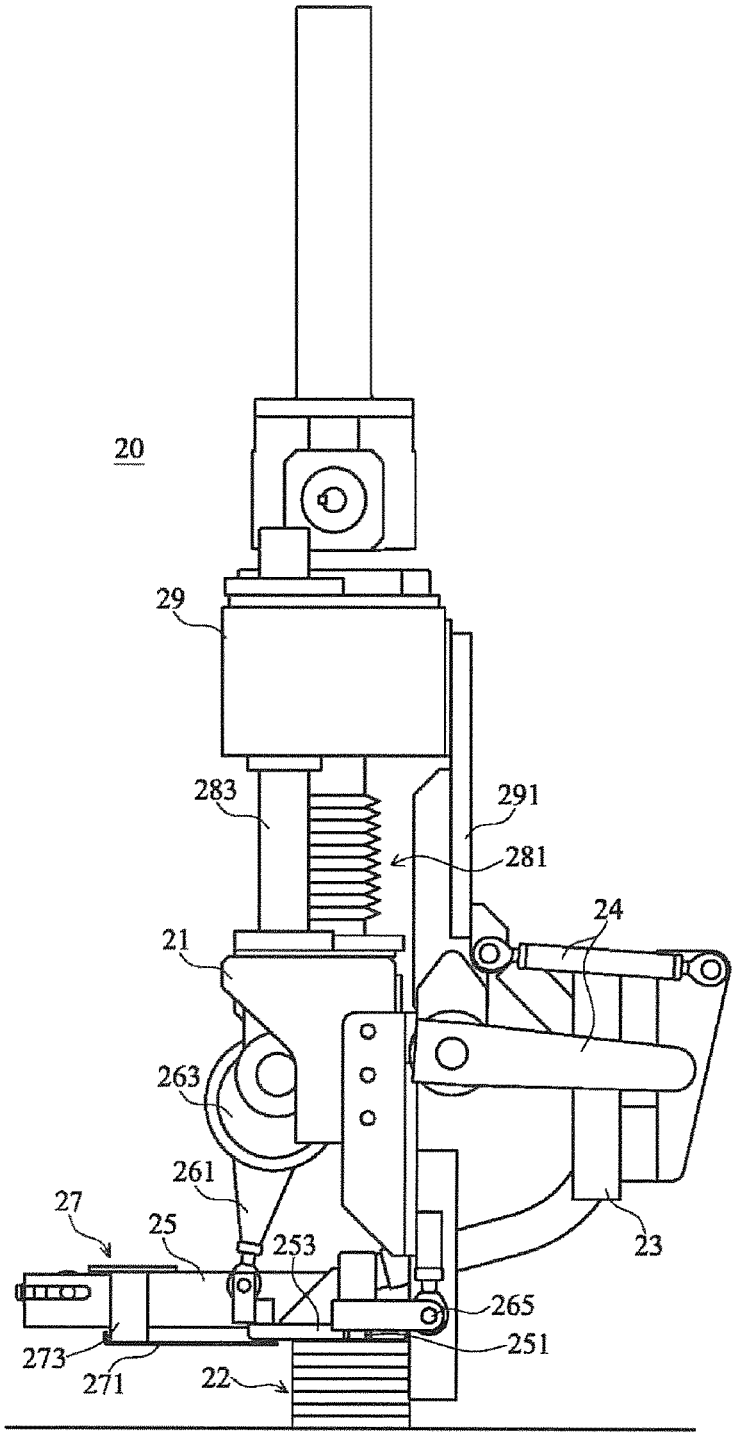
FIG. 2 is a side view of an embodiment of a fiber product folding apparatus of the present invention.
Figure 3:
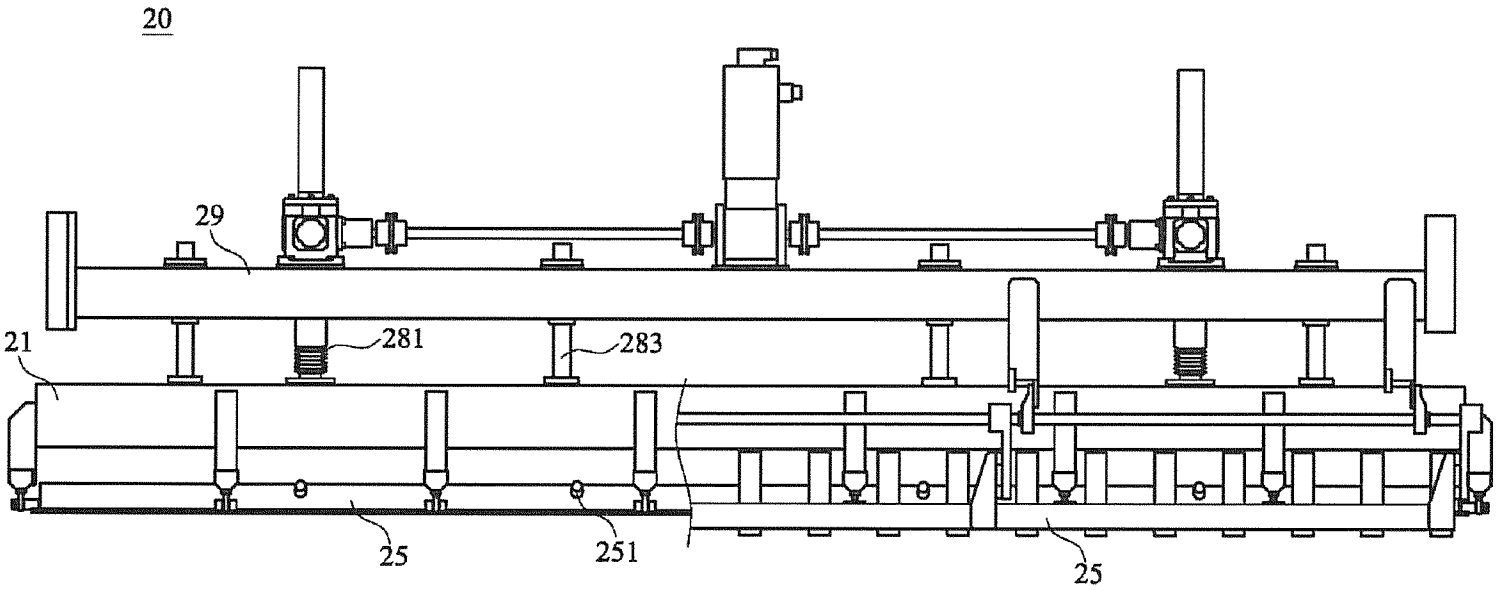
FIG. 3 is a schematic diagram of a front-view section of an embodiment of a fiber product folding apparatus of the present invention.

Reference may be made to FIG. 2 and FIG. 3, which are a side view and a schematic diagram of a front-view section of an embodiment of a fiber product folding apparatus of the present invention. As shown in the drawings, a fiber product folding apparatus 20 mainly includes a hoisting seat 21, a baffle 23, a pressing plate 25, and a folding portion 27, where the hoisting seat 21 is connected to the pressing plate 25, and the folding portion 27 is arranged on the pressing plate 25.

The baffle 23 is connected to at least one swing arm 24, where the swing arm 24 actuates the baffle 23 to swing, and the baffle 23 is used to block stacked fiber products 22 that are conveyed, so that the stacked fiber products 22 are restricted to a predetermined position, thereby facilitating folding the fiber products 22 by the fiber product folding apparatus 20. The baffle 23 can be connected to a fixed seat 29 through at least one swing arm 24, so that the baffle 23 can swing relative to the fixed seat 29. Specifically, an end of the swing arm 24 is connected to the baffle 23, and another end of the swing arm 24 is connected to the fixed seat 29, for example, the fixed seat 29 can include a connecting portion 291 and is connected to an end of the swing arm 24 through the connecting portion 291, where the swing arm 24 can use the end connected to the fixed seat 29 and/or the connecting portion 291 as a fulcrum and actuate the baffle 23 to swing relative to the fixed seat 29 and/or connecting portion 291. During actual application, the end of the swing arm 24 connected to the fixed seat 29 and/or connecting portion 291 can also be connected to a driving apparatus, for example, a motor, and the swing arm 24 is driven by the motor to swing with the end connected to the fixed seat 29 and/or connecting portion 291 as a fulcrum, no as to actuate the baffle 23 connected to the swing arm 24 to swing and move upward and downward. Certainly, driving the swing arm 24 and baffle 23 by means of a motor to swing is merely an implementation manner of the present invention rather than a limitation to the present invention. In a different embodiment, a cylinder may also be connected between two ends of the swing arm 24, and the swing arm 24 and baffle 23 are actuated by means of the cylinder to swing.

In an embodiment of the present invention, either one swing arm 24 or more swing arms 24 can achieve a purpose of actuating the baffle 23 to swing. In a preferred embodiment of the present invention, a number of swing arms 24 can be two or more. When the number of swing arms 24 is two, an end of each of the two swing arms 24 may be connected to a different position of the fixed seat 29 and/or connecting portion 291, and another end of each of the two swing arms 24 is connected to a different position of the baffle 23. The two swing arms 24 may be substantially in parallel to each other, for example, the two swing arms 24 can form a parallel linkage, or the two swing arms 24, the fixed seat 29 (or connecting portion 291), and the baffle 23 can form a mechanism similar to a parallel four-bar linkage.

When the two swing arms 24 actuate the baffle 23 to swing relative to the fixed seat 29 and/or connecting portion 291, an angle of the baffle 23 can be kept unchanged, for example, when the swing arms 24 actuate the baffle 23 to swing relative to the fixed seat 29 and/or connecting portion 291, the baffle 23 may be continuously kept at an angle substantially perpendicular to the horizontal plane, which would be beneficial to blocking and restricting a position of the fiber products 22 by means of the baffle 23.

In an embodiment of the present invention, an end of the swing arm 24 being connected to the fixed seat 29 and/or connecting portion 291 is mainly used as an implementation manner, However, during actual application, an end of the swing arm 24 that is not connected to the baffle 23 only needs to connect to another component, so as to achieve the purpose of actuating the baffle 23 to swing. Hence, in another embodiment of the present invention, an end of the swing arm 24 that is not connected to the baffle 23 can also be connected to the hoisting seat 21, and an actuating manner thereof is the same as that in the foregoing embodiment, which is not repeatedly described therein.

The pressing plate 25 is connected to the hoisting seat 21 through at least one connecting rod 261 and at least one connecting unit 265, where the connecting rod 261 and connecting unit 265 are separately connected to different positions of the pressing plate 25, and the connecting unit 265 would not move relative to the pressing plate 25 and/or connecting unit 265, so that the pressing plate 25 can swing with the connecting unit 265 as a pivotal support. For example, an end of the pressing plate 25 may be connected to the hoisting seat 21 through the connecting unit 265, and the connecting rod 261 is connected to another position or another end of the pressing plate 25, where the connecting rod 261 can actuate the pressing plate 25 to swing with the connecting unit 265 as a pivotal support, so that the pressing plate 25 gets in contact with the topmost fiber product among the stacked fiber products 22.

In an embodiment of the present invention, an end of the connecting rod 261 that is not connected to the pressing plate 25 can be connected to a driving unit 263, so that the connecting rod 261 is connected to the hoisting seat 21 through the driving unit 263, where the driving unit 263 is used to drive the connecting rod 261 to actuate the pressing plate 25 to swing with the connecting unit 265 as a pivotal support. During actual application, the driving unit 263 may be a component such as a crankshaft or a cylinder, and certainly, the crankshaft or cylinder is merely an implementation manner of the present invention rather than a limitation to the present invention.

In addition, the pressing plate 25 can also be used to pressurize a to-be-folded fiber product 22 and fold the stacked fiber products 22. At least one absorbing unit 251 can be arranged on a surface or a part of the surface of the pressing plate 25, for example, the absorbing unit 251 can be arranged on the surface of the pressing plate 25 that is closer to the side of the baffle 23 and/or connecting unit 265, and when the pressing plate 25 gets in contact with the topmost fiber product 22, the absorbing unit 251 arranged on the surface of the pressing plate 25 would also get in contact with the fiber product 22. The absorbing unit 251 can be used to generate negative pressure and absorb the topmost fiber product among the stacked fiber products 22. When the connecting rod 261 actuates the pressing plate 25 to swing upward, the pressing plate 25, that would actuate a part of the fiber product 22 that is absorbed by the absorbing unit 251 to lift upward, so as to facilitate folding the topmost fiber product 22 by the folding portion 27.

During actual application, the pressing plate 25 may include a press-fitting unit 253 and get in contact with and press-fit the topmost stacked fiber product 22 through the press-fitting unit 253, and the absorbing unit 251 is arranged on a part of a surface of the press-fitting unit 253. For example, the absorbing unit 251 may be a tiny hole arranged on the surface of the press-fitting unit 253 that is closer to the side of the baffle 23 and/or connecting unit 265, where the absorbing unit 251 may be connected to an air extraction apparatus through a pipeline, so that the absorbing unit 251 generates negative pressure to absorb a part of the fiber product 22.

The folding portion 27 is mainly used to fold the fiber products 22, and is, in particular, used to fold the topmost or first fiber product 22. The folding portion 27 is arranged on the pressing plate 25 and can move along the pressing plate 25, and when the folding portion 27 moves toward the fiber products 22, the folding portion 27 would get in contact with and fold a fiber product 22 that is not absorbed by the absorbing unit 251, for example, folding a sagging fiber product 22, and the detailed folding manner would be described in a subsequent embodiment.

In an embodiment of the present invention, the folding portion 27 may include a folding plate 271 and a connecting seat 273, where the folding plate 271 is connected to the pressing plate 25 through the connecting seat 273, and the connecting seat 273 can actuate, along a direction of the pressing plate 25, the folding plate 271 to move. For example, at least one rail can be arranged on the pressing plate 25, and the connecting seat 273 is arranged inside the rail and can move along the rail. In addition, the folding portion 27 and/or connecting seat 273 can be connected to a cylinder, where the cylinder can be used to drive the folding portion 27, connecting seat 273, and/or folding plate 271 to move along the rail or pressing plate 25. Certainly, the cylinder is merely an implementation manner of the present invention rather than a limitation to the present invention, and for persons of ordinary skill in the art, the cylinder can be replaced by another driving apparatus.

In an embodiment of the present invention, the fiber product folding apparatus 20 can also include a fixed seat 29 and a hoist driving unit 281, where a hoisting seat 21 is connected to the fixed seat 29 through the hoist driving unit 281. The fixed seat 29 is a fixed and stationary component, while the hoist driving unit 281 can be used to drive the hoisting seat 21 to move relative to the fixed seat 29. When the hoist driving unit 281 is elongated, the hoist driving unit 281 would actuate the hoisting seat 21, pressing plate 25, and/or folding portion 27 to move downward, for example, relatively getting away from the fixed seat 29, and when the hoist driving unit 281 contracts, the hoist driving unit 281 would actuate the hoisting seat 21, pressing plate 25, and/or folding portion 27 to move upward, for example, getting close to the fixed seat 29. In another embodiment of the present invention, if the baffle 23 is connected to the hoisting seat 21 through the swing arm 24, the hoisting seat 21 would actuate the baffle 23 to move upward and downward while moving.

In addition, in order to increase stability when the hoisting seat 21 moves relative to the fixed seat 29, the fixed seat 29 and hoisting seat 21 can also be further connected through a slide rail 283. When the hoist driving unit 281 is elongated or contracts, the hoist driving unit 281 would actuate the hoisting seat 21 to move upward and downward along the slide rail 283. The arrangement of the slide rail 283 may increase the stability when the hoisting seat 21 moves, but the slide rail 283 is not a necessary component of the present invention and is not a limitation to the present invention either.

Reference may be made to FIG. 4 to FIG. 10, which are action flowcharts of an embodiment of folding a fiber product by a fiber product folding apparatus of the present invention. As shown in the drawings, with reference to FIG. 2 and FIG. 3, a fiber product folding apparatus 20 mainly includes a hoisting seat 21, a baffle 23, a pressing plate 25, and a folding portion 27, where the hoisting seat 21 is connected to the pressing plate 25, and the folding portion 27 is arranged on the pressing plate 25.

Figure 4:
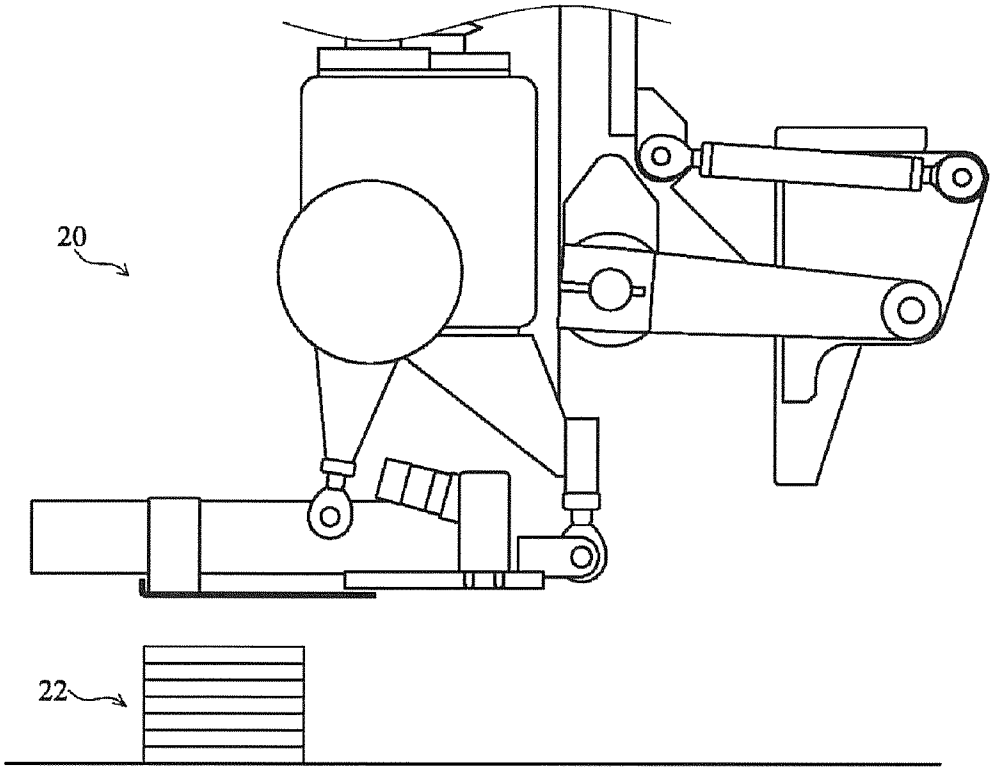
FIG. 4 to FIG. 10 are action flowcharts of an embodiment of folding a fiber product by a fiber product folding apparatus of the present invention.

In a process of folding a fiber product 22, stacked fiber products 22 can be carried or conveyed by a conveying apparatus or a conveying belt, and the stacked fiber products 22 are conveyed to a position below the fiber product folding apparatus 20, as shown in FIG. 4.

Figure 5:
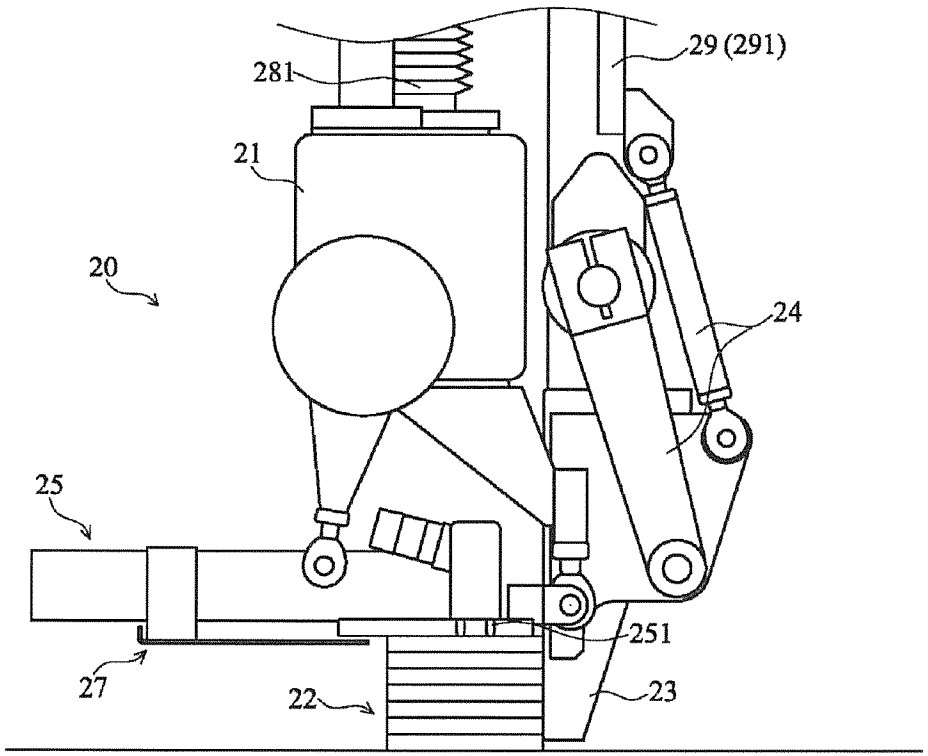

When the stacked fiber products 22 are conveyed to a specific position, a swing arm 24 would actuate the baffle 23 to swing downward, for example, the swing arm 24 is driven by a motor or a cylinder to actuate the baffle 23 to swing, and the baffle 23 is used to block the stacked fiber products 22, as shown in FIG. 5. The number of swing arms 24 may be one or more, and in the embodiment of the present invention, the swing arms 24 may be arranged as a pair, where an end of each of the two swing arms 24 is connected to the baffle 23, and another end of each of the two swing arms 24 is connected to a fixed seat 29, a connecting portion 291 of the fixed seat 29, or a hoisting seat 21. In addition, the paired swing arms 24 may be substantially in parallel to each other, so that the two swing arms 24 form a parallel linkage, or the two swing arms 24, the fixed seat 29 (or connecting portion 21), and the baffle 23 form a construction of a parallel four-bar linkage. During a process that the swing arm 24 actuates the baffle 23 to swing relative to the fixed seat 29 or hoisting seat 21, an angle of the baffle 23 is kept by means of the foregoing construction, for example, the baffle 23 can be kept at an angle substantially perpendicular to the horizontal plane or a conveying direction of the fiber products 22, which is beneficial to blocking the stacked fiber products 22 by the baffle 23.

In addition, when the swing arm 24 actuates the baffle 23 to swing downward, at the same time, a hoist driving unit 281 can also actuate the hoisting seat 21, pressing plate 25, and folding portion 27 to move downward, for example, moving toward the fiber product 22, so as to enable the pressing plate 25 to get in contact with the topmost fiber product 22. Certainly, during implementation and application, an action that the hoisting seat 21 moves downward and an action that the baffle 23 swings downward can be carried out at the same time or sequentially, for example, first the hoisting seat 21 is driven to move downward and then the baffle 23 is driven to swing downward, or first the baffle 23 is driven to swing downward, and then the hoisting seat 21 is driven to move downward. The foregoing action sequence would not affect a result of folding the fiber product 22 and would not be a limitation to the present invention either.

In an embodiment of the present invention, a sensing unit, for example, an optical sensing unit, can also be arranged on a conveying path of the fiber products 22, and a position of the fiber products 22 is sensed by the sensing unit. For example, when sensing the fiber products 22, the sensing unit transmits a sensed signal to the fiber product folding apparatus 20, and the fiber product folding apparatus 20 would drive the hoisting seat 21 to move downward and drive the baffle 23 to swing downward.

When the hoisting seat 21 moves downward and enables the pressing plate 25 to get in contact with the fiber products 22, the absorbing unit 251 arranged on the pressing plate 25 would generate negative pressure and absorb a part of the first fiber product 22. Then, a driving unit 263 can actuate the pressing plate 25 through the connecting rod 261 to swing upward, for example, the pressing plate 25 is connected and/or fixed to the hoisting seat 21 through the connecting unit 265, and the connecting rod 261 is connected to an end of the pressing plate 25 that is not connected to hoisting seat 21 and connecting unit 265, so that the driving unit 263 can actuate the pressing plate 25 through the connecting rod 261 to swing upward with a position connected to the hoisting seat 21 and connecting unit 265 as a pivotal support.

Figure 6:
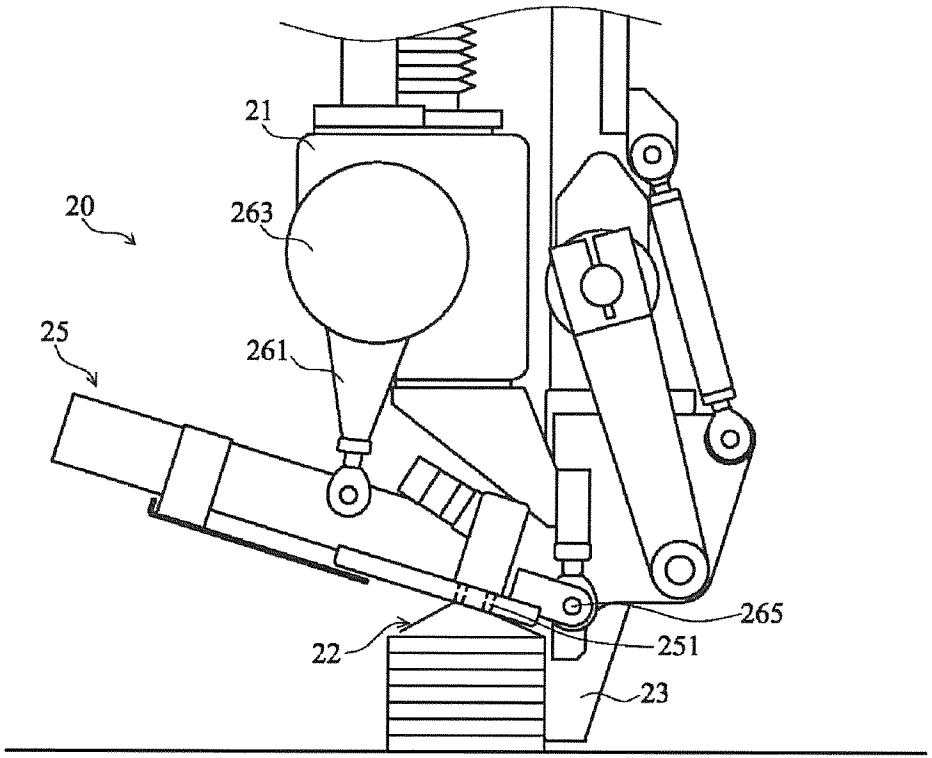

When the pressing plate 25 swings upward, at the same time, the fiber product 22 absorbed by the absorbing unit 251 on the pressing plate 25 would also be pulled up. In an embodiment of the present invention, the absorbing unit 251 can be arranged on an end of the pressing plate 25 that is closer to the baffle 23 and/or connecting unit 265, so that the absorbing unit 251 would only absorb the fiber product 22 on the end that is closer to the baffle 23 and/or connecting unit 265. When the pressing plate 25 swings upward, the fiber product 22 on the end that is closer to the baffle 23 would be pulled up, and the fiber product 22 that is farther from the baffle 23 would sag because of the effect of gravity since it is not absorbed by the absorbing unit 251, as shown in FIG. 6.

Figure 7:
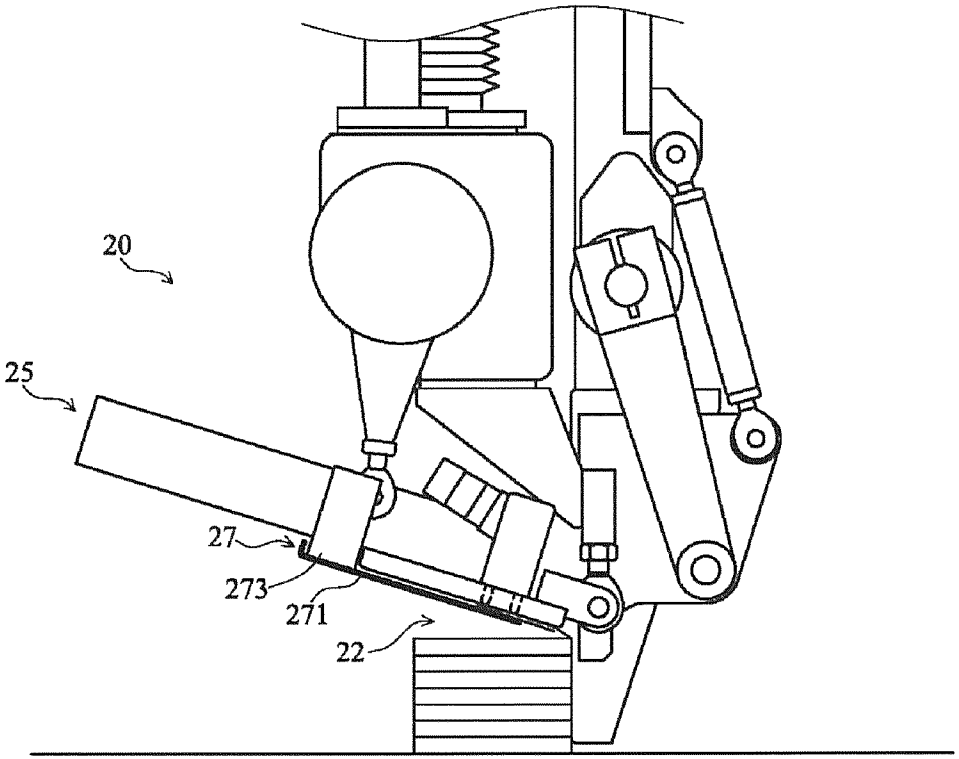

After the pressing plate 25 would swing upward to a predetermined position or angle, the folding portion 27 arranged on the pressing plate 25 would move downward along the pressing plate 25, for example, moving toward the fiber product 22. Because when the pressing plate 25 swings upward, the fiber product 22 that is not absorbed by the absorbing unit 251 would sag because of the effect of gravity, when the folding portion 27 moves toward the fiber product 22, the sagging fiber product 22 would be folded inward or downward, so that the sagging fiber product 22 would be folded below the absorbed fiber product 22, as shown in FIG. 7.

In an embodiment of the present invention, the folding portion 27 may include a folding plate 271 and a connecting seat 273, where the folding plate 271 is connected to the pressing plate 25 through the connecting seat 273, and the connecting seat 273 can actuate, along a direction of the pressing plate 25, the folding plate 271 to fold or push a sagging fiber product 22.

Figure 8:
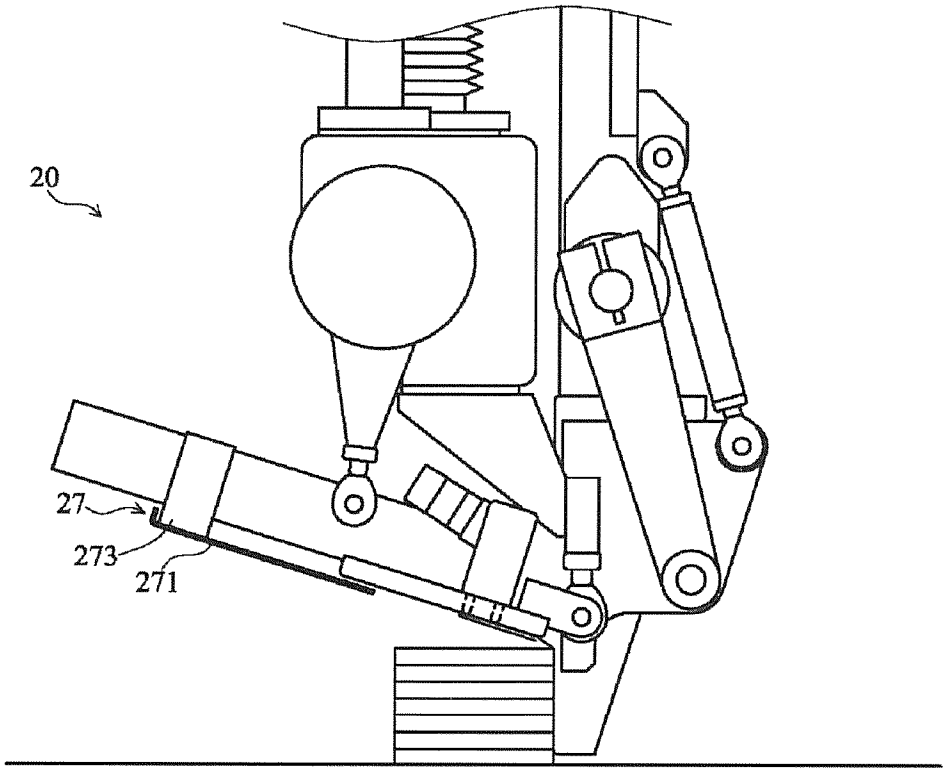

When the folding portion 27 and/or folding plate 271 complete(s) a step of folding the sagging fiber product 22, the folding portion 27 and/or folding plate 271 would contract back, as shown in FIG. 8.

Figure 9:
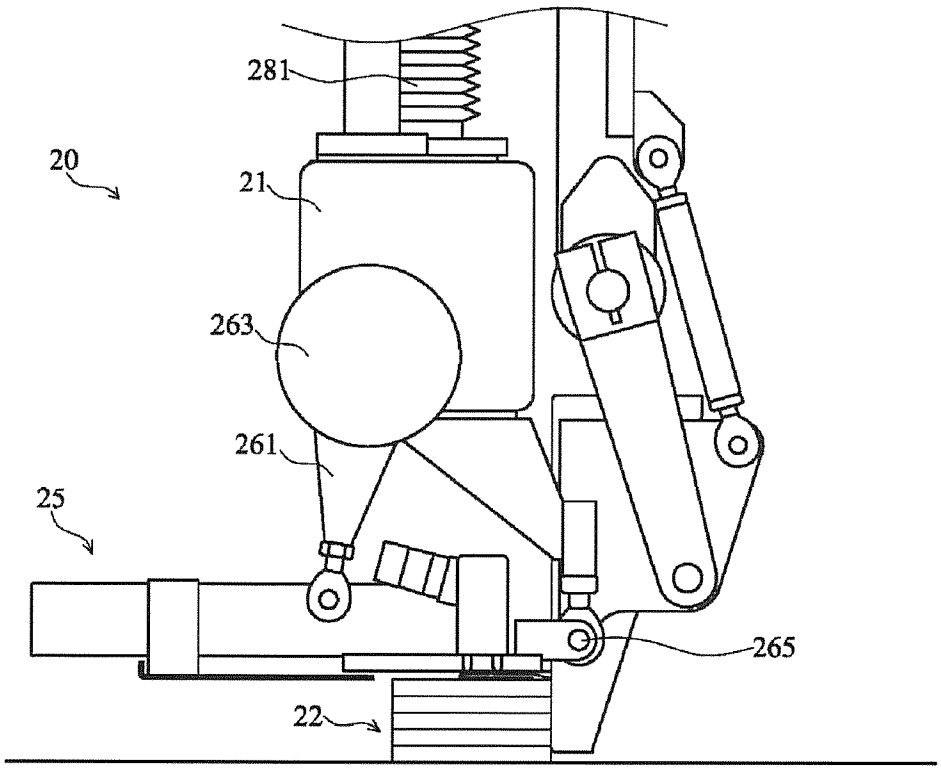

When the folding portion 27 contracts back, the driving unit 263 would drive the pressing plate 25 through the connecting rod 261 to swing downward, for example, the pressing plate 25 swings downward with a part or an end connected to the hoisting seat 21 and connecting unit 265 as a pivotal support, so that the pressing plate 25 gets in contact with and presses the folded fiber product 22, so as to actually fold the topmost (first) fiber product 22, as shown in FIG. 9.

In another embodiment of the present invention, the hoist driving unit 281 can also drive the hoisting seat 21 and the pressing plate 25 connected to the hoisting seat 21 to move downward and pressurize the fiber product 22 through the pressing plate 25, so as to further actually fold the topmost (first) fiber product 22. In addition, the fiber products 22 can be compressed or reshaped by means of the pressing plate 25, which is beneficial to execution of a subsequent action of packing the fiber products 22. When the hoisting seat 21 is driven by the hoist driving unit 281, a step of enabling the pressing plate 25 connected to the hoisting seat 21 to further pressurize the fiber product 22 is not a necessary step of the present invention and is not a limitation to the present invention either.

Figure 10:
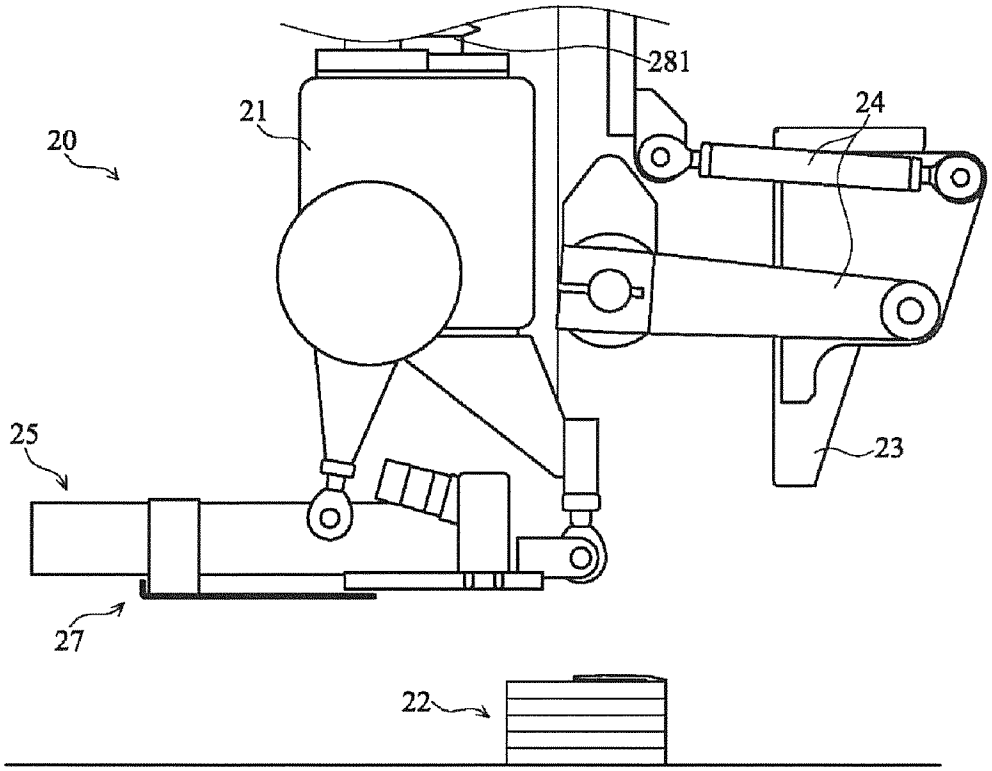

After the fiber product folding apparatus 20 completes folding the topmost first fiber product 22, the swing arm 24 would actuate the baffle 23 to swing upward, so that the baffle 23 would no longer block a traveling path of the fiber products 22. In addition, the hoist driving unit 281 would drive the hoisting seat 21, pressing plate 25, and folding portion 27 to move upward, so that the pressing plate 25 is not in contact with the fiber product 22. Then, the conveying apparatus carrying the fiber products 22 would actuate the folded fiber product 22 to move downstream, as shown in FIG. 10.

The connection in the present invention refers to a direct connection or an indirect connection between one or more objects or components, for example, one or more intermediate connection objects may exist between one or more articles or components.

Words, such as possibly, must, and change, described in the system of the present specification are not limitations to the present invention. The technical terms used in the specification are mainly used to describe specific embodiments and are not limitations to the present invention. The singular quantifiers (for example, one or this) used in the specification, unless explicitly specified in the content of the specification, may also be plural. For example, one apparatus mentioned in the specification may include a combination of two or more apparatuses, while one substance mentioned in the specification may include a mixture of multiple types of substances.

The foregoing embodiments are merely preferred embodiments of the present invention instead of limiting the scope of implementation of the present invention, that is, equivalent variations and modifications made according to the shape, construction, feature, and spirit of the patent application scope of the present invention, shall all be included in the patent application scope of the present invention.

What is claimed is:

1. A fiber product folding apparatus, comprising:

a hoisting seat;

a baffle connected to at least one swing arm, wherein the swing arm actuates the baffle to swing, and the baffle being configured to block a stack of fiber products;

a pressing plate connected to the hoisting seat through at least one connecting rod and at least one pivotal support, wherein the connecting rod is configured to actuate the pressing plate to swing about the pivotal support, so that the pressing plate comes in contact with the topmost fiber product of the stacked fiber products;

at least one absorbing unit arranged on a surface of the pressing plate and configured to take up the topmost fiber product of the stacked fiber products; and a folding portion arranged on the pressing plate, wherein the folding portion moves along the pressing plate and is configured to fold the topmost fiber product among the stacked fiber products.

2. The fiber product folding apparatus according to claim 1, wherein the connecting rod is connected to the hoisting seat through a driving unit, and the driving unit is configured to drive the connecting rod to actuate the pressing plate to swing about the pivotal support.

3. The fiber product folding apparatus according to claim 2, wherein the driving unit is a cylinder or a crankshaft.

4. The fiber product folding apparatus according to claim 1, wherein the folding portion comprises a folding plate and a connecting seat, the folding plate being connected to the pressing plate through the connecting seat, and the connecting seat being configured to actuate the folding plate to move along the pressing plate.

5. The fiber product folding apparatus according to claim 1, wherein the baffle is connected to the hoisting seat through the swing arm.

6. The fiber product folding apparatus according to claim 1, wherein the number of swing arms is at least two, and the swing arms are in parallel to each other and form a parallel linkage.

7. The fiber product folding apparatus according to claim 1, wherein the absorbing unit is arranged on a portion of the surface of the pressing plate.

8. The fiber product folding apparatus according to claim 7, wherein the portion of the surface of the pressing plate to which the absorbing unit is arranged is closer to a side of the pressing plate connected to the pivotal support.

* * * * *